US011059696B2

(12) United States Patent
Kasbergen

(10) Patent No.: US 11,059,696 B2
(45) Date of Patent: Jul. 13, 2021

(54) PLATFORM LIFT

(71) Applicant: TK HOME SOLUTIONS B.V., Krimpen aan den Ijssel (NL)

(72) Inventor: Paul Kasbergen, Capelle aan den Ijssel (NL)

(73) Assignee: TK Home Solutions B.V., Krimpen aan den Ijssel (NL)

( * ) Notice: Subject to any disclaimer, the term of this patent is extended or adjusted under 35 U.S.C. 154(b) by 0 days.

(21) Appl. No.: 16/612,555

(22) PCT Filed: May 15, 2018

(86) PCT No.: PCT/EP2018/062484
§ 371 (c)(1),
(2) Date: Nov. 11, 2019

(87) PCT Pub. No.: WO2018/215238
PCT Pub. Date: Nov. 29, 2018

(65) Prior Publication Data

US 2020/0198928 A1 Jun. 25, 2020

(30) Foreign Application Priority Data

May 23, 2017 (EP) ..... 17172544

(51) Int. Cl.
*B66B 1/34* (2006.01)
*B66B 5/00* (2006.01)
*B66B 9/08* (2006.01)

(52) U.S. Cl.
CPC ..... *B66B 1/3461* (2013.01); *B66B 5/0006* (2013.01); *B66B 9/08* (2013.01)

(58) Field of Classification Search
CPC ..... B66B 9/08; B66B 1/3461
See application file for complete search history.

(56) References Cited

U.S. PATENT DOCUMENTS

| | | | | |
|---|---|---|---|---|
| 4,904,916 | A | 2/1990 | Gisske | |
| 6,093,146 | A * | 7/2000 | Filangeri | G16H 40/67 600/300 |
| 8,660,565 | B2 * | 2/2014 | Hall | B66B 9/08 455/447 |
| 2008/0268831 | A1 | 10/2008 | Hall | |
| 2015/0068847 | A1 | 3/2015 | Ooms | |

(Continued)

FOREIGN PATENT DOCUMENTS

| | | | |
|---|---|---|---|
| CN | 204847687 | U | 12/2015 |
| EP | 1 554 210 | B | 12/2008 |
| EP | 1 938 048 | B | 12/2010 |

(Continued)

OTHER PUBLICATIONS

International Search Report issued in PCT/EP2018/062484, dated Aug. 24, 2018 (dated Sep. 3, 2018).

*Primary Examiner* — Diem M Tran
(74) *Attorney, Agent, or Firm* — William J. Cassin

(57) ABSTRACT

A platform lift, in particular a stairlift, including a rail, a drive unit having a platform, in particular a chair, for driving along the rail, at least one control unit arranged at the drive unit, a speech communication device located at the drive unit, a base station located at a fixed location, and one wireless transmission path connecting the control unit and the speech communication device to the base station.

12 Claims, 5 Drawing Sheets

(56) References Cited

U.S. PATENT DOCUMENTS

2017/0337796 A1* 11/2017 Helal ..... G08B 3/10

FOREIGN PATENT DOCUMENTS

| | | | | | |
|---|---|---|---|---|---|
| EP | 2 377 795 | B | | 11/2012 | |
| EP | 2 825 494 | A | | 1/2015 | |
| EP | 2 825 841 | A | | 1/2015 | |
| EP | 2 895 415 | A | | 7/2015 | |
| EP | 2 951 097 | A | | 12/2015 | |
| JP | 2012-184062 | A | | 9/2012 | |
| WO | WO-2010141865 | A1 | * | 12/2010 | ..... G06F 19/00 |
| WO | 2013/129923 | A | | 9/2013 | |
| WO | 2013/137730 | A | | 9/2013 | |
| WO | 2013137733 | A | | 9/2013 | |
| WO | 2014/041351 | A | | 3/2014 | |
| WO | 2014/118564 | A | | 8/2014 | |
| WO | 2015/052489 | A | | 4/2015 | |
| WO | WO-2017178803 | A1 | * | 10/2017 | ..... A61G 7/05 |
| WO | WO-2020049271 | A1 | * | 3/2020 | ..... B66B 9/08 |

* cited by examiner

PLATFORM LIFT

CROSS REFERENCE TO RELATED APPLICATIONS

This application is a U.S. National Stage Entry of International Patent Application Serial Number PCT/EP2018/062484, filed May 15, 2018, which claims priority to European Patent Application No. EP 17172544.3, filed May 23, 2017, the entire contents of both of which are incorporated herein by reference.

FIELD

The present disclosure generally relates to a platform lift and a platform lift service network.

BACKGROUND

The invention refers to a platform lift and a platform lift service network.

A platform, in particular a stairlift, lift is a product which is typically meant for people with impaired mobility, mostly elderly people, to provide support to get upstairs and downstairs without removing the staircase and thus maintaining the functionality of the stairs for persons which are (still) able to climb the stairs themselves. The platform lift is often installed in people's homes and typically comprises a drive unit with a chair or another platform, driven by a drive, which drives along a rail, mounted on or along one or more staircases.

EP 1 554 210 A1 discloses a platform lift for the use of a disabled person in a wheelchair. WO 2013/129923 A1 discloses a platform lift in the form of a stairlift. In both cases the platform is part of a drive unit which travels along at least one guide rail. A leveling mechanism is provided to hold the platform always in a horizontal orientation, even if the inclination angle of the guide rail is changing along the path of travel. In particular the rail of such platform lifts has a curved shape, like shown in FIG. 3 of WO 2015/052489 A1.

To minimize the obtrusion of the drive unit when it is not used, there is the possibility to park the drive unit at another position than the landing area ('Park'-functionality). The remote control button device for this feature is based on a wireless radio technology. Another wireless applications of the lift is the possibility to setup a voice connection through a telephone line, in case the user needs help when the lift is not moving halfway of the staircase ('Voice'-functionality). This connection can be based on the DECT technology. Although these two RF devices do not have to function simultaneously this still can lead to interference of the two RF devices. For both RF devices it is needed to go through the certifying process in the different countries where the lift is to be sold. Furthermore two RF devices mean twice the component costs.

US 2008/0268831 A1 (the reference numerals mentioned within this paragraph refers to the figure in US 2008/0268831 A1) discloses a stairlift having a fault monitoring system 10. The fault monitoring system 10 has a control board 14, which is attached at the movable chair 12 of the stairlift. The monitor 10 further comprises a transmitter 16 located at the chair, to transmit a fault code via wireless data connection 16-18 to a remote destination server 20 and a computer 22. The remote destination server 20 and the computer 22 are obviously not a part of the stairlift but rather form a observations station for a service technician. The wireless transmission uses usual public telecommunication means like SMS, GSM, GPRS. For enabling data transmission, a SIM card is provided. Consequently the communication system described herein is merely intended for submitting data to a remote destination outside of the stairlift. A communication of components within the stairlift to the stairlift, e.g. a remote control of the stairlift, is not part of the disclosure.

Thus a need exists for an improved platform lift.

DETAILED DESCRIPTION

Figure 1:
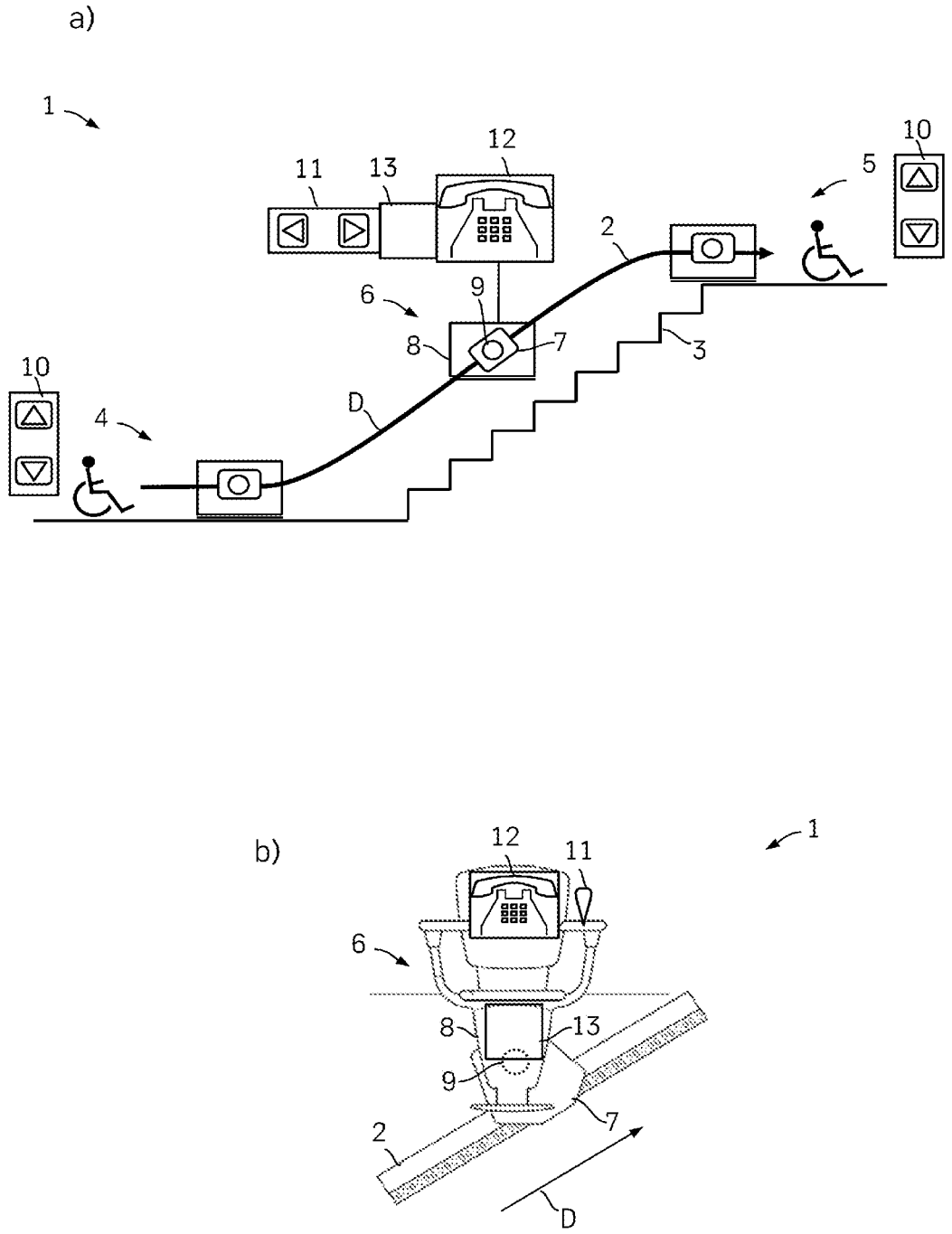
FIG. 1*a* is a side view of a platform lift.
FIG. 1*b* is a side view of a platform lift.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention refers to a platform lift and a platform lift service network.

The inventive platform lift, in particular stairlift, comprises a rail, a drive unit having a platform, in particular a chair, for driving along the rail, at least one control unit arranged at the drive unit, a speech communication device located at the drive unit, a base station located at a fixed location. Further exactly one wireless transmission path is provided for the control unit and the speech communication device to the base station.

In particular the wireless transmission path is in adapted to transmit a data signal from the control unit and a speech signal from the communication device to the base station, thereby using the same transmission protocol. With transmission protocol is in particular meant the protocol which defines the data link layer according to Layer 2 of the OSI model. Alternatively or in combination thereto the wireless transmission path is adapted to transmit a data signal from the control unit and a speech signal from the communication device to the base station, thereby using the same transmission frequency or frequency band. The advantage is that merely one transmission technology needs to be implemented in the lift.

In particular the same applies for the call devices located at the landing area. So preferably at least one call device located at a landing area is provided, wherein the call device is wireless connected to the control unit via the wireless transmission path, in particular wherein the wireless transmission path is adapted to transmit a data signal from the call device to the control unit thereby using the same transmission frequency, transmission frequency band and/or the same transmission protocol. A call device may comprise a button; when pressing the button the drive unit will requested to travel to the respective landing area. Such call devices may have similar functionality as the hall call buttons of conventional elevator installations. The prior art (e.g. US 2008/0368831 A1) does not disclose to use the speech telecommunication means for additionally transmitting a call received from the call device, which initiates a movement of the platform.

Preferably the base station comprises a telecommunication interface to connect the platform lift with a public telecommunication network. It is thus possible that through the public telecommunication network and the wireless transmission path a service technician has contact to the user sitting on the drive unit and having access to the data within in the control unit, by establishing merely one/exact one wireless connection within the platform lift.

In particular the DECT-technology can be used as for establishing the wireless transmission, since it can be made suitable for processing voice signals as well as control signals. In this case only one device is needed to implement both functionalities: 'Call and Park' and 'Voice'. When the stairlift is not in use, it is also possible to send the stairlift status through a telephone line.

This can be used to perform remote diagnostics. E.g.: the user calls the helpdesk and the helpdesk can readout the stairlift status and diagnose the problem. Using one device for wireless applications or features will have the following advantages: decrease costs for certification, decrease product costs, enable more specific assistance to the user.

The inventive platform lift service network, comprising a plurality of platform lift according to the lift describe herein. Each of the platform lifts are connected via the telecommunication network to a distant server of a service provide, wherein the data signals and speech signals are transmitted from the platform to the distant server using the wireless transmission path and the public telecommunication network.

FIG. 1 shows two exemplary embodiments of a generic platform lift 1, to which the invention can be applied. In FIG. 1*a* a platform lift 1 for the use with a wheelchair is shown. The platform 8 therefore comprises a lifting ramp, which can travel along a direction of travel D from a first landing area 4 to a second landing area 5. The direction of travel D is defined by a rail 2 and is limited in main by the course of an existing stairway 3 in a house. An alternative embodiment is shown in FIG. 1*b* wherein the platform 8 comprises a seat.

The rail 2 has a curved shape, which deviates from a straight line; thus the direction of travel will change at least once during the course of the rail 2.

The platform 8 is part of a drive unit 6, which further comprises a carrier 7. The carrier 7 has non-shown rollers, which roll along the rail 2. For driving the carrier 7 positive engagements means (only shown in detail in FIG. 1*b*) are provided on the rail 2, which cooperates with driving means, in particular a driven pinion (not shown), of the drive unit 6. A leveling mechanism 9 is provided on the drive unit 6, to keep the platform 8 always in a horizontal orientation, even if the inclination of the rail 2 varies during its course.

At the landing areas a call button device 10 is provided. By pressing a button of the call button device 10 a user located at the respective landing area can request that the platform 8 to move in certain direction (e.g. up or down or in direction of one of the landing areas 4, 5; 'Call-and-Park'-function).

At the drive unit 6 a control interface 11 is provided, so that the user moving with the platform 6 can give instructions to the drive on the intended driving direction of the drive unit 6. As an example the control interface 11 can be a button 11 (FIG. 1*a*) or a joystick 11 (FIG. 1*b*). A speech communication device 12, in particular a telephone, is provided at the drive unit 8 for establishing a speech connection with a remote technical service, in case a fault occurs during travel.

Figure 2:
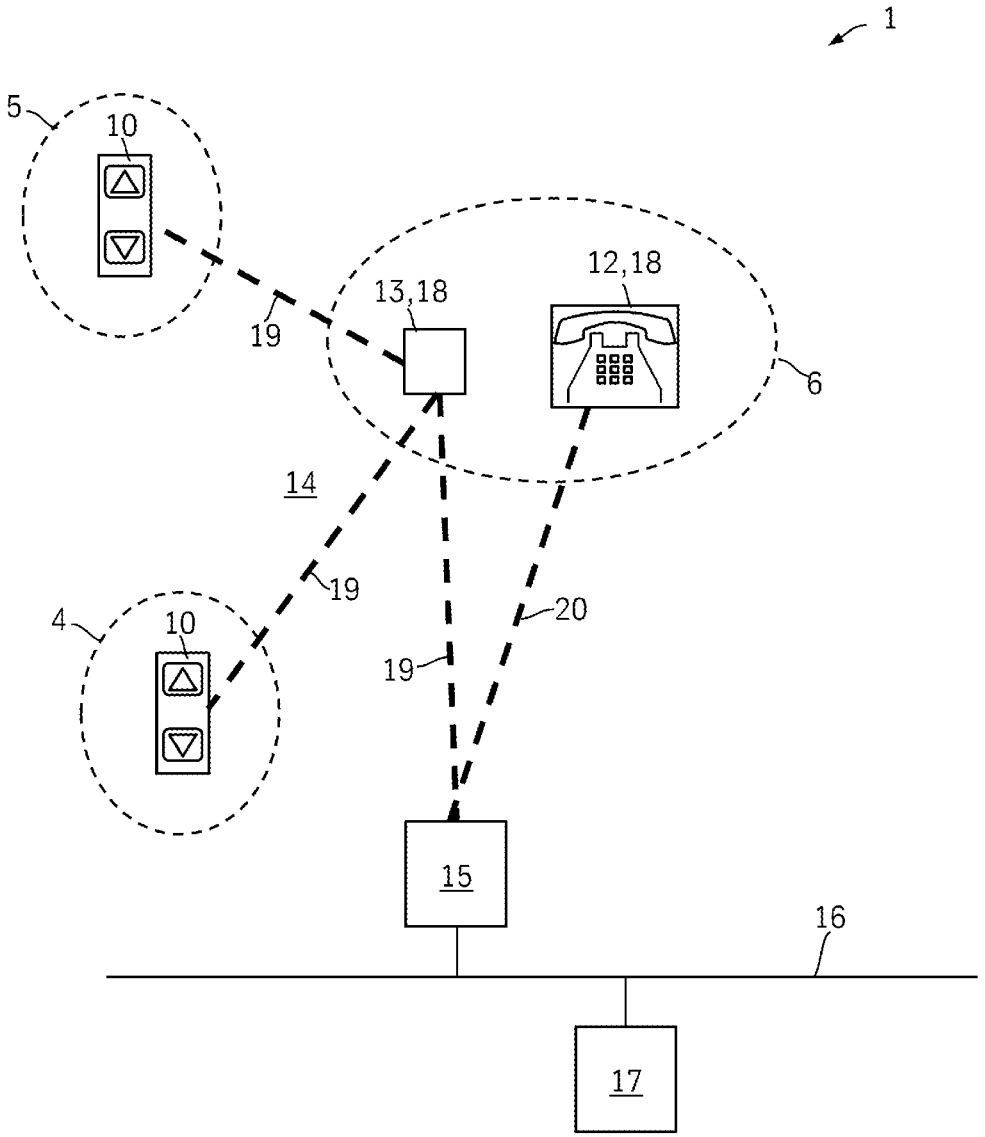
FIG. 2 is a schematic diagram of an inventive stairlift.
Figure 3:
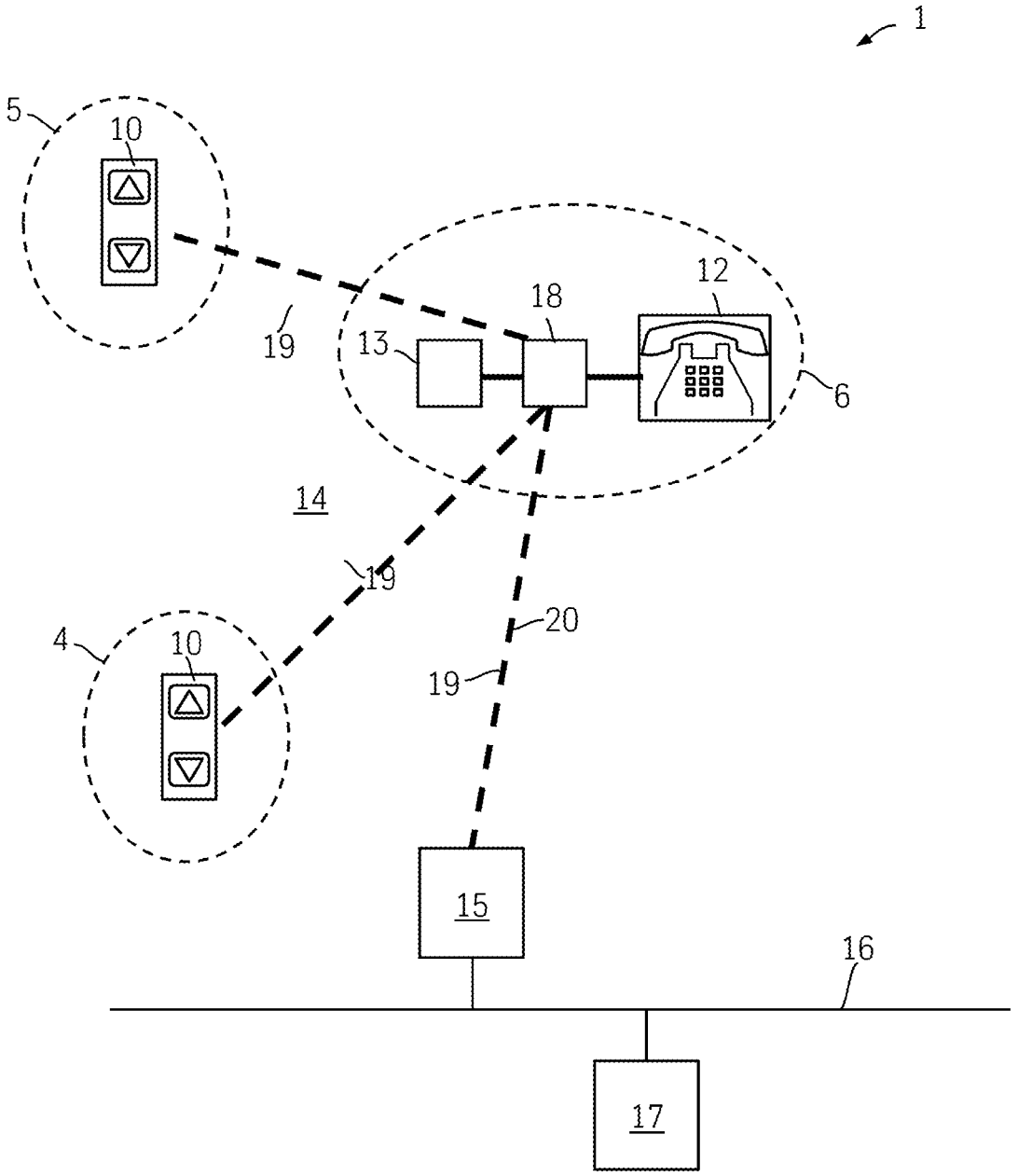
FIG. 3 is a schematic diagram of another inventive stairlift.
Figure 4:
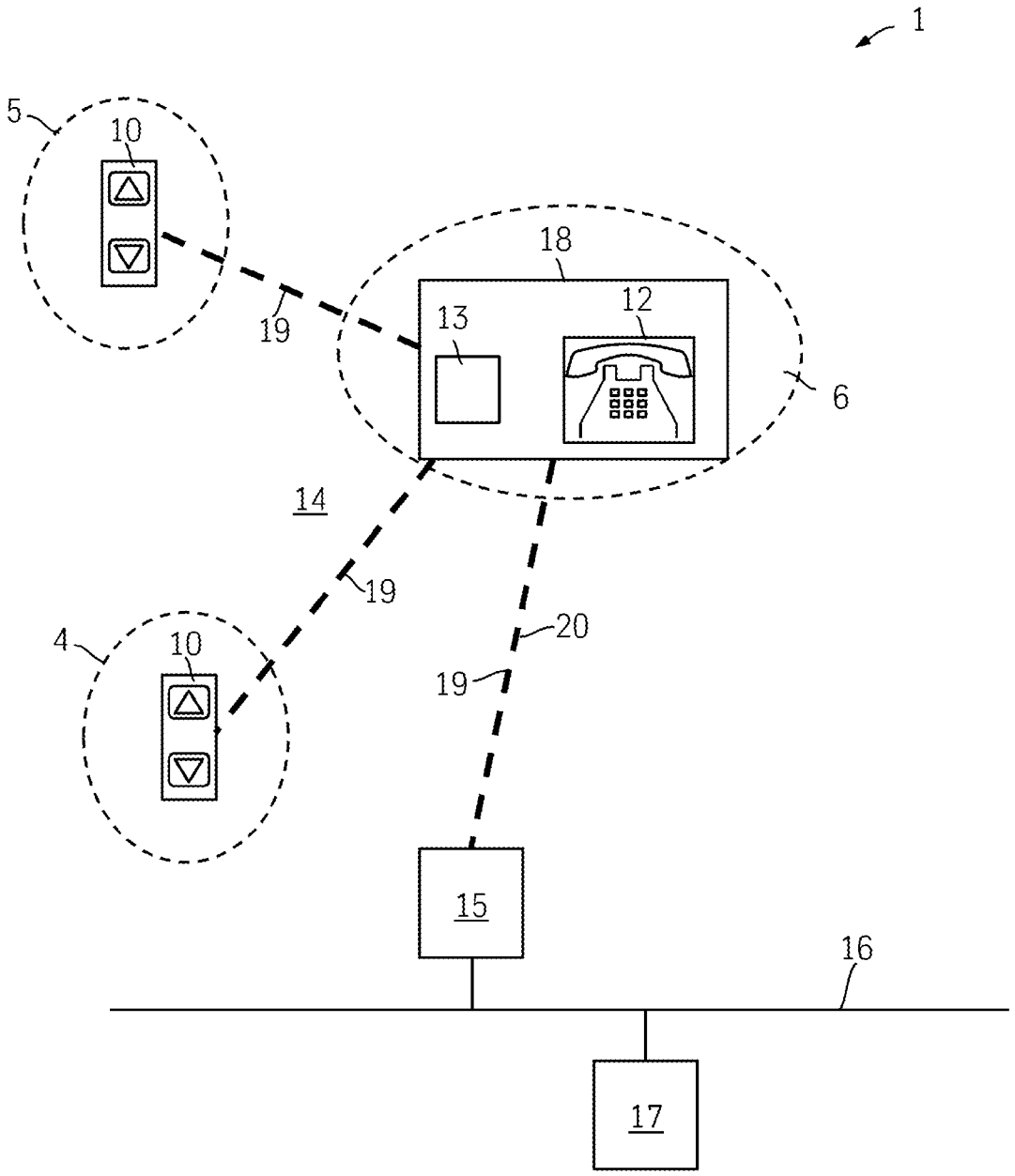
FIG. 4 is a schematic diagram of another inventive stairlift.

The inventive platform lift is now described in more details with the help of FIGS. 2, 3 and 4; the differences in the embodiments of the FIGS. 2 to 4 are described later separately.

FIG. 2-4 shows a schematic diagram of the electronic components of the lift 1. For the proper operation of the lift 1 several communication connections are provided. So the call device 10 at landing areas 4, 5 need to send and/or receive data to/from a control unit 13 located at the drive unit 6. The speech communication device 12 at the drive unit 6 communicates with a fixed base station 15. Also the control unit 13 at the drive unit 6 communicates with the fixed base station 15 to transmit data signals 19. Also the communication between the control interfaces 11 at the landing areas 4, 5 is performed via the wireless communication path 14. The base station 15 has an interface to a public telecommunication network 16 (e.g. telephone net or broadband data net) to establish a connection between lift and the distant server 17 of a service provider. The connection between the base station 15 and the remote server 17 provides a possibility to exchange data information between the control unit 13 and the server and to exchange speech information between the speech communication 12 and the remote server 17.

According to the invention all described devices 10, 13, 12 use the same wireless communication path 14, which uses the DECT-technology. Therefore at least one telecommunication interface 18 is provided at the drive unit 6 to establish a communication connection via the wireless transmission path 14 with the base station 15.

At the drive unit 6 of FIG. 2 the control unit 13 comprises a telecommunication interface 18 and the speech communication device 12 comprises a separate telecommunication interface 18.

At the drive unit 6 of FIG. 3 the control unit 13 and the speech communication device 12 uses commonly the same telecommunication interface 18.

At the drive unit 6 of FIG. 4 the control unit 13 and the speech communication device 12 are components of a common telecommunication interface 18.

A suitable transmission path is wireless technology using the DECT-standard. With the DECT standard only one type of radio device is necessary to establish the path 14. So only one time a certification has to be performed in each country. During a call between the user sitting on the platform with a service technician located near the server 17 the service technician can retrieve data from the control unit 13 via the same data connection.

Figure 5:
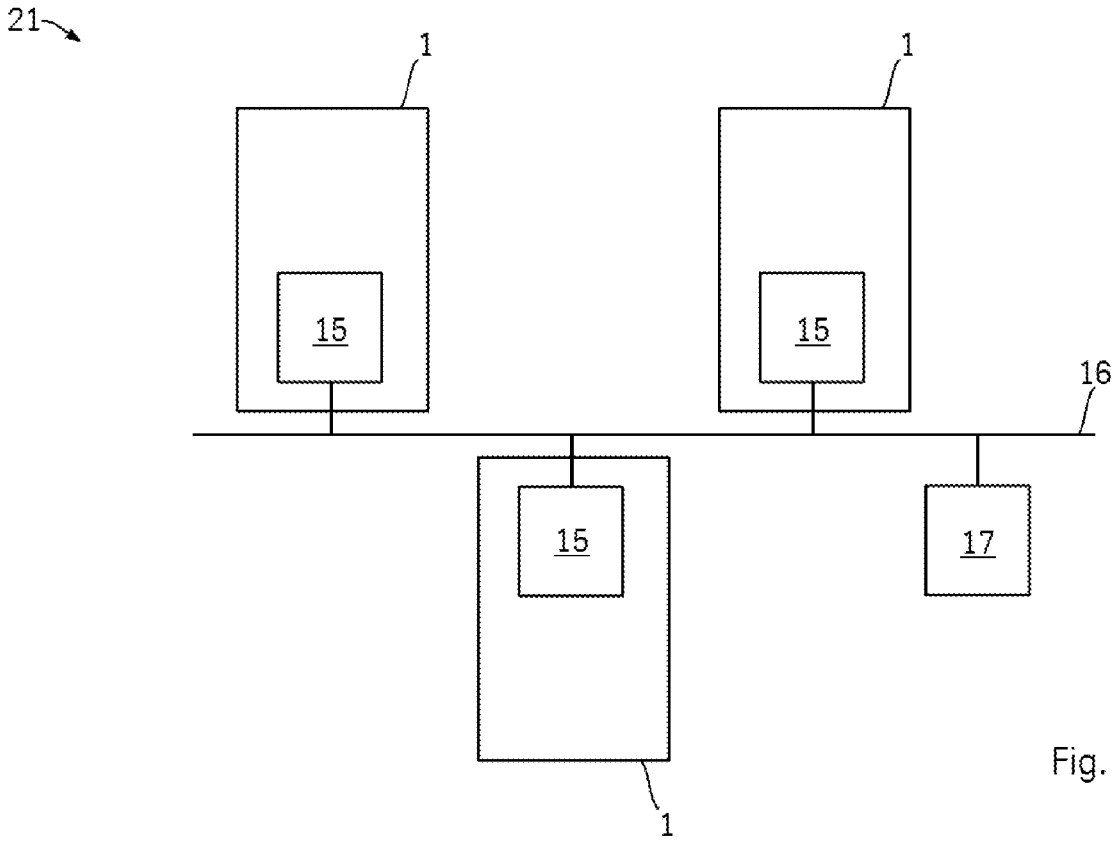
FIG. 5 is a schematic diagram of an inventive platform lift service network.

FIG. 5 shows a platform lift service network 21, wherein several platform lifts 1 of the described type are connected via a public telecommunication network to the remote server 17.

LIST OR REFERENCE SIGNS

1 platform lift
2 rail

3 stairs
4 first landing area
5 second landing area
6 drive unit
7 carrier
8 platform/seat
9 leveling mechanism
10 call device at landing area
11 control button device/control joystick device at drive unit
12 speech communication device at drive unit
13 control unit
14 wireless transmission path
15 base station with telecommunication interface public telecommunication network
16 public telecommunication network
17 distant server of a service provider
18 telecommunication interface at drive unit
19 data signal
20 speech signal
21 platform lift network
D path of travel D

What is claimed is:

1. A platform lift, comprising:

a rail;

a drive unit comprising a platform configured to drive along the rail;

at least one control unit disposed at the drive unit;

a speech communication device disposed at the drive unit;

a base station locally located at a fixed location at the installation site of the platform lift, which base station includes a telecommunication interface configured to connect the platform lift to a distant server of a service provider via a public telecommunication network; and exactly one wireless transmission path utilizing a single transmission protocol that connects both of the control unit and the speech communication device to the base station;

wherein the one wireless transmission path is configured to transmit a data signal from the control unit and a speech signal from the speech communication device to the base station using the same single transmission protocol.

2. The platform lift of claim 1, wherein the platform lift is a stairlift.

3. The platform lift of claim 1, wherein the platform includes a chair.

4. The platform lift of claim 1, wherein the one wireless transmission path is configured to transmit a data signal from the control unit and a speech signal from the speech communication device to the base station using a same transmission frequency or a same transmission frequency band.

5. The platform lift of claim 1, wherein at least one call device is located at a landing area, wherein the call device is wirelessly connected to the control unit via the one wireless transmission path.

6. The platform lift of claim 5, wherein the one wireless transmission path is configured to transmit a data signal from the call device to the control unit using a same transmission frequency and/or a same transmission protocol.

7. A platform lift service network, comprising a plurality of platform lifts each according to claim 1, wherein the plurality of platform lifts are connected via a telecommunication network to a distant server of a service provider, wherein the telecommunications network is configured such that data signals and speech signals are transmitted from each of the plurality of platform lifts to the distant server, by each platform lift respectively using its own respective one wireless transmission path, and the public telecommunication network.

8. The platform lift of claim 7, further comprising:

a control interface configured to permit a user located at the platform to input instructions to the drive unit on a desired driving direction of the drive unit.

9. The platform lift of claim 8, wherein the control interface is a button.

10. The platform lift of claim 1, wherein the control interface is a joystick.

11. The platform lift of claim 1, wherein the base station is configured to exchange a data signal between the control unit and the distant server, and exchange a speech signal between the speech communication device and the distant server.

12. The platform lift of claim 1, wherein the exactly one wireless transmission path uses DECT technology as the single transmission protocol.

* * * * *